US008212804B2

(12) United States Patent
Chi et al.

(10) Patent No.: US 8,212,804 B2
(45) Date of Patent: Jul. 3, 2012

(54) INTEGRATED CIRCUIT FOR CONTROLLING OPERATIONS OF DISPLAY MODULE AND FIRST CIRCUIT MODULE WITH SHARED PIN

(75) Inventors: Yi-Chih Chi, Taipei (TW); Tsai-Tian Huang, Taipei (TW)

(73) Assignee: ALI Corporation, Taipei (TW)

( * ) Notice: Subject to any disclaimer, the term of this patent is extended or adjusted under 35 U.S.C. 154(b) by 590 days.

(21) Appl. No.: 12/408,732

(22) Filed: Mar. 23, 2009

(65) Prior Publication Data

US 2010/0110066 A1 May 6, 2010

(30) Foreign Application Priority Data

Oct. 31, 2008 (CN) ..... 2008 1 0171017

(51) Int. Cl.
*G09G 5/00* (2006.01)

(52) U.S. Cl. ..... 345/214

(58) Field of Classification Search ..... 345/214, 345/204, 87, 98, 99, 559, 618; 365/201; 710/11, 12, 105; 714/32
See application file for complete search history.

(56) References Cited

U.S. PATENT DOCUMENTS 4,102,491 A * 7/1978 DeVito et al. ..... 714/32
4,307,392 A * 12/1981 Loshbough et al. ..... 345/618
4,894,796 A * 1/1990 Engel et al. ..... 345/559
5,630,170 A * 5/1997 Koizumi et al. ..... 710/12
6,335,720 B1 * 1/2002 Mori et al. ..... 345/98
6,670,940 B2 * 12/2003 Kim ..... 345/98
7,084,840 B2 * 8/2006 Moon ..... 345/87
7,095,391 B2 * 8/2006 Lee ..... 345/87
7,133,016 B2 * 11/2006 Kim ..... 345/99
7,191,256 B2 * 3/2007 Adams et al. ..... 710/11
7,191,268 B2 * 3/2007 Adams et al. ..... 710/105
7,426,149 B2 * 9/2008 Kim et al. ..... 365/201
2002/0177482 A1 * 11/2002 Cheong et al. ..... 463/39
2007/0220499 A1 * 9/2007 Bannatyne et al. ..... 717/140
2009/0322711 A1 * 12/2009 David et al. ..... 345/204

* cited by examiner

*Primary Examiner* — Fred Tzeng

(74) *Attorney, Agent, or Firm* — Winston Hsu; Scott Margo

(57) ABSTRACT

An integrated circuit for controlling a display module and a first circuit module with a shared pin includes: a shared pin, a display control module, a first control module, and a pin-sharing management module. The display control module is for controlling operations of the display module, wherein the display module is externally coupled to the integrated circuit via the shared pin. The display control module generates a pin-sharing control signal according to its operating status. The first control module is for controlling operations of the first circuit module, wherein the first circuit module is externally coupled to the integrated circuit via the shared pin. The pin-sharing management module is coupled to the display control module, the first control module and the shared pin and grants one of the display and first control modules access to the shared pin according to the pin-sharing control signal.

20 Claims, 7 Drawing Sheets

INTEGRATED CIRCUIT FOR CONTROLLING OPERATIONS OF DISPLAY MODULE AND FIRST CIRCUIT MODULE WITH SHARED PIN

BACKGROUND OF THE INVENTION

1. Field of the Invention

The present invention relates to an IC having shared pins, and more particularly, to an IC having shared pins that is able to control a display module and more than one circuit module externally coupled to the IC.

2. Description of the Prior Art

As electronic products are increasingly developed to be light, thin, short and small, electronic elements inside these electronic products should be of small size and weight for decreasing the internal space of electronic products occupied by these electronic elements.

Typically, microminiaturization of some electronic elements relies on the progression and development of semiconductor processes. Continually downsizing electronic elements, however, will result in a bottleneck. As well as microminiaturization of electronic elements, integrating several chips within an IC package (System in a Package, SiP) or arranging several circuits in a single IC (System on Chip, SoC) are other choices for downsizing electronic elements. These options usually involve several different circuits, which require pins for connecting to external electronic elements/devices, in either a SoC or a SiP. As the complexity of circuitry inside an IC packages increases, pin count of the IC package also increases.

In modern electronic products, such as PCs, portable media players or even thumb drives with an LCD panel (for displaying file names and storage status), display modules and memory modules are indispensable parts. Due to the popularity of these two circuit modules, the corresponding control modules are considered as the objects of microminiaturization. For example, by means of Soc or Sip, the above-mentioned two kinds of control modules can be implemented within one IC package. In smaller electronic products like portable media players and thumb drives, a liquid crystal display (LCD) is usually utilized as a display apparatus, and a micro hard disk or a flash memory module is utilized as a data storage apparatus. Thus, the following description utilizes "LCD display module" and "flash memory module" for illustration and ease of understanding.

In the prior art, different pin allocations for an IC having control modules for both a display apparatus and a memory apparatus are shown in FIG. 1 and FIG. 2, respectively.

As shown in FIG. 1, an IC 100 (an IC package) includes a data access control module (that is, a flash memory control module 110) and a display control module (that is, an LCD control module 120). The flash memory control module 110 and the LCD control module 120 both possess their own control signal pins 111, 121 and data signal pins 112, 122 for electrically connecting a memory module (a flash memory module 130) and a display module (an LCD display module 140), respectively.

Furthermore, an IC 200 shown in FIG. 2 also includes a flash memory control module 210 and an LCD display control module 220. Unlike the control modules shown in FIG. 1, the flash memory control module 210 and the LCD display control module 220 utilize a same pair of control and data signal pins 211, 212 to electrically connect a flash memory module 230 and an LCD display module 240. Compared to the IC 100 shown in FIG. 1, the IC 200 shown in FIG. 2 has a smaller pin count, thereby decreasing the size of the wiring board and the IC package, and even the power consumption.

According to the NTSC (National Television System Committee) standard, a refresh rate is 60Hz, which means that the LCD display control modules 120 and 220 have to finish a frame refresh operation within $1/60^{th}$ of a second. Thus, the LCD display control modules 120 and 220 have to transmit data and control signals to the LCD display modules 140 and 240 for refreshing the LCD display modules 140 and 240 every $1/60^{th}$ of a second. As shown in FIG. 2, under the condition that the control modules use shared pins, while the flash memory control module 210 is accessing the flash memory module 230, the refresh timing of the LCD display control module 220 may already have been reached. If the LCD display control module 220 cannot finish the data transmission to the LCD display module 240 before the refresh timing, some problems such as flickering or displaying faults may occur. To prevent the above-mentioned problems, there is usually a frame buffer disposed in a conventional LCD display module like the frame buffers 141 and 241 shown in FIG. 1 and FIG. 2. The frame buffers 1 41 and 241 can buffer the frame data for a next refresh timing by storing the frame data corresponding to the next $1/60^{th}$ of a second into the frame buffers 141 and 241 in advance. Therefore, the condition that the LCD display control module has not yet transmitted the frame data is avoided.

However, allocating a frame buffer in the display module increases hardware cost thereof. Thus, the advantages of utilizing shared pins to decrease the pin count shown in FIG. 2 are cancelled out. As the control modules in the integrated circuit shown in FIG. 1 for controlling the display module and the memory module possess their own pins, the frame buffer in the display module is unnecessary. As a result, from the point of view of a designer, whether a display control module uses shared pins in an IC becomes a dilemma.

SUMMARY OF THE INVENTION

As mentioned above, production costs for electronic products can be lowered down if a memory control module (or other control module) and a display control module in an IC can employ the same pins to correctly control a memory device (or other circuit module) and a low-cost display module without any frame buffer.

With this in mind, it is one objective of the present invention to provide an IC with a shared pin. The IC of the present invention includes a display control module and other control modules (such as a memory control module), which are respectively utilized for controlling a display module and other circuit modules (such as a memory module). By the utilization of control signals between different control modules in the IC, a process similar to the handshaking protocol proceeds in the IC of the present invention in order to decide the priority of different control modules for accessing the shared pin. More accurately, in the IC of the present invention, other control modules can use the shared pin for controlling corresponding external circuit modules at the timing that the display control module does not need to access the shared pin for refreshing the display module.

Furthermore, the present invention utilizes a pin-sharing management module to properly and precisely control the timing that each control module is allowed to access the shared pin. By the pin-sharing management module, each control module can access the shared pin without contending with the display control module; thereby the frame buffer becomes unnecessary for the display module. Production cost of the display module can therefore be decreased.

An integrated circuit for controlling operations of a display module and a first circuit module with shared pin is provided according to one exemplary embodiment of the present invention. The integrated circuit comprises: a shared pin, a display control module, a first control module, and a pin-sharing management module. The display control module is employed for controlling operations of the display module externally coupled to the integrated circuit via the shared pin, wherein the display control module further generates a pin-sharing control signal according to an operation status of the display control module. The first control module is employed for controlling operations of the first circuit module externally coupled to the integrated circuit via the shared pin. The pin-sharing management module is coupled to the display control module, the first control module and the shared pin, and employed for granting one of the display control module and the first control module access to the shared pin according to the pin-sharing control signal.

A method for controlling a display module and a first circuit module by utilizing a display control module and a first control module in an integrated circuit is provided according to another exemplary embodiment of the present invention. The method comprises: coupling the display module, the first circuit module, the display control module, and the first control module to a shared pin of the integrated circuit; generating a pin-sharing control signal according to the operating status of the display control module; and checking whether the pin-sharing control signal is asserted; the display control module being granted to access the display module via the shared pin if the pin-sharing control signal is asserted while the first control module is granted to access the first circuit module via the shared pin if the pin-sharing control signal is not asserted.

In accordance with the pin-sharing control signal, the pin-sharing management module can properly grant one of the display control module and the other control module the access right of the shared pin. Thus, the pin-sharing management module can make the other control module control the corresponding circuit module in a steady and efficient manner under the condition that the display control module can exactly control the display module without any frame buffer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
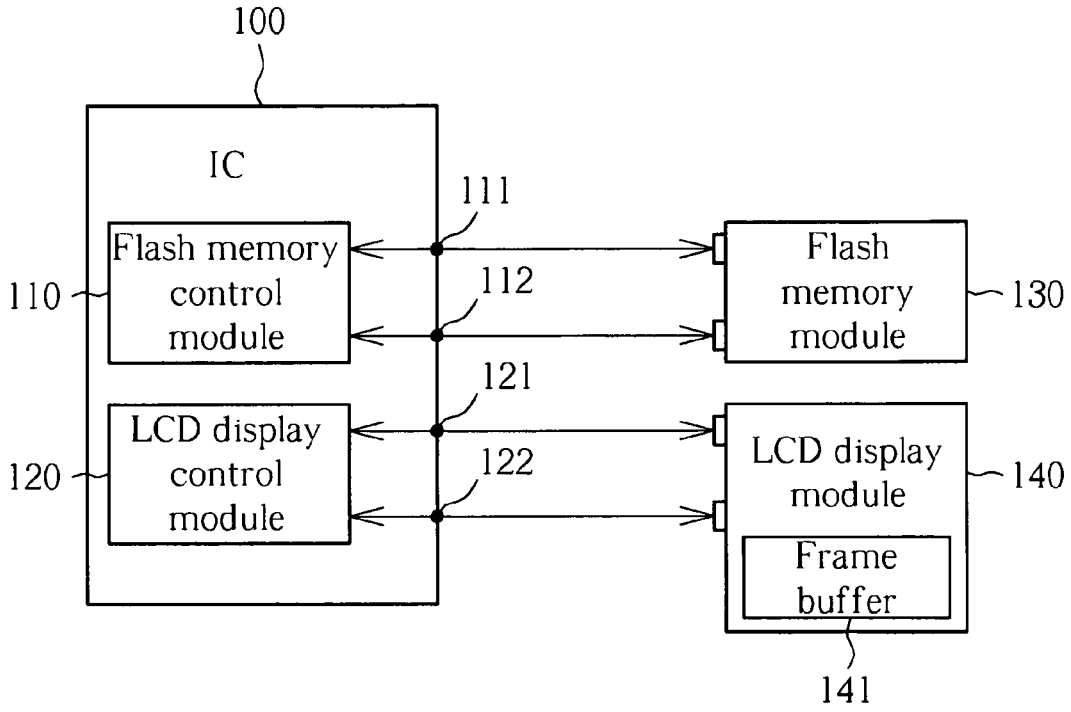
FIG. 1 PRIOR ART
FIG. 1 is a block diagram of a conventional IC for controlling a display module and a memory module.
Figure 2:
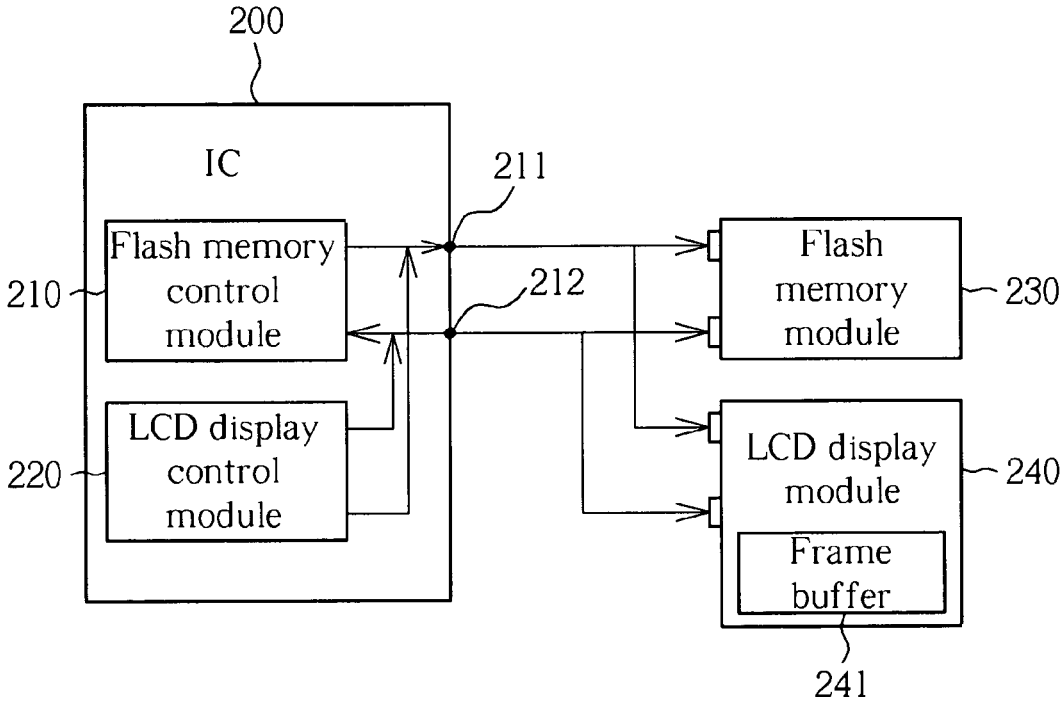
FIG. 2 PRIOR ART
FIG. 2 is a block diagram of a conventional IC for controlling a display module having a frame buffer and a memory module via a shared pin.

Please note that the following descriptions will take a flash memory control module as an example for representing the control module that shares pins with the display control module in a same IC, but this is not meant to be a limitation of the present invention. In other words, the first control module in other exemplary embodiments of the present invention is not necessarily a flash memory control module.

In the present invention, one of the technical features is sharing pins between different control modules including a display control module utilized for controlling a display module without any frame buffer in a single IC. Thus, considering the priority of different control modules for the shared pin, the priority belonging to the display control module must be higher than the priority belonging to the other control modules (such as a flash memory control module); otherwise, flickering or other faults on the display module may appear if the timing at which the other control modules access the shared pin overlaps the timing at which the display control module accesses the shared pin.

Thus, the present invention employs three different control signals for communication purposes between different control modules. Firstly, a "pre-busy" signal, generated by the display control module having higher priority, is employed. The pre-busy signal is transmitted to the control modules having lower priority to remind the control modules having lower priority of completing operations currently processing on the shared pin as soon as possible. Secondly, a "busy" signal, generated by the display control module having higher priority, is employed. The busy signal is generated at the moment that the display control module is accessing (in other words, occupying) the shared pin and the busy signal is asserted until the display control module does not access the shared pin. Thirdly, an "enablement" signal, used for controlling the circuit modules (the display module and the flash memory module) externally coupled to the shared pin whether to accept the signal existing on the share pin, is employed. Via the said three control signals, different control modules in the IC can properly utilize the shared pin for controlling the corresponding circuit module externally coupled to the IC without any contention.

It should be noted that the above-mentioned pre-busy signal and busy signal do not have to exist in a same IC simultaneously. Obviously, the pre-busy signal and the busy signal substantially have the same objective, and the biggest difference between the pre-busy signal and the busy signal is the time when the pre-busy signal and the busy signal are generated: the pre-busy signal should be generated earlier than the busy signal. As a result, in the practical implementations, a display control module could only have the busy signal, and the pre-busy signal can therefore be replaced with the busy signal by generating the busy signal at the timing that the pre-busy signal should originally be generated. Detailed implementations are well known to those skilled in the art, so further descriptions about implementations are omitted for the sake of brevity.

Because the meanings regarding the pre-busy signal and the busy signal in the following part of the detailed description are explained as mentioned above, the claimed pin-sharing control signal actually comprehends both the pre-busy signal and the busy signal. Furthermore, in the following part of the detailed description, the term "LCD_PREBUSY" signal is used to stand for the pre-busy signal, "LCD_BUSY" signal is used to stand for the busy signal, and "NF_CSJ", "LCD_CSJ" is used to stand for the enablement signal.

Figure 3:
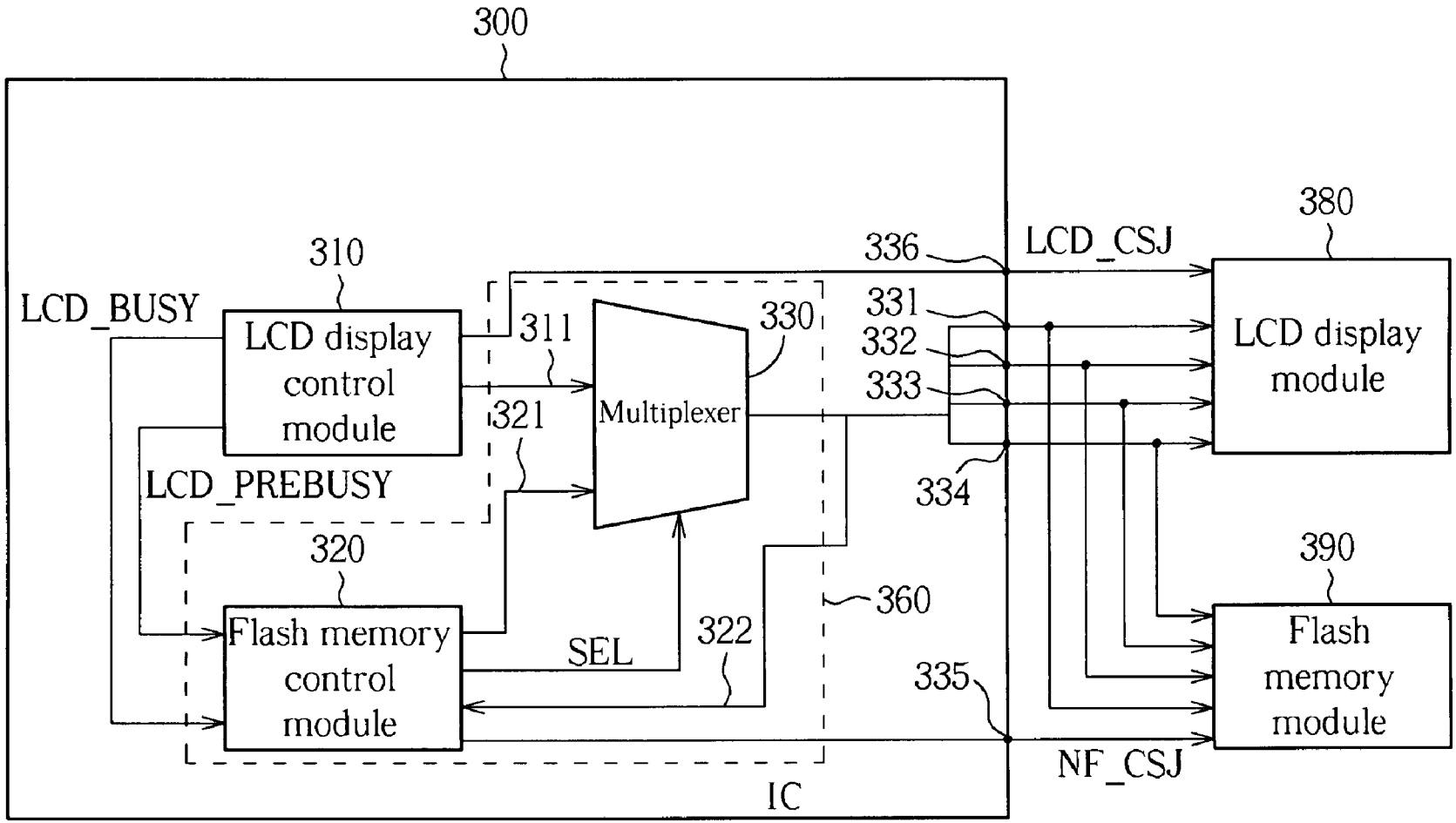
FIG. 3 is a block diagram of an IC for controlling a display module without a frame buffer and a memory module via a shared pin according to one exemplary embodiment of the present invention.

Please refer to FIG. 3, which illustrates a block diagram of an IC with shared pins according to one exemplary embodiment of the present invention. An IC 300 (IC package) comprises an LCD display control module 310 and a flash memory control module 320, which are respectively utilized for controlling an LCD display module 380 and a flash memory module 390 via shared pins 331-334, wherein the LCD display control module 310 is coupled to a flash memory control module 320, and the LCD display control module 310 generates the LCD_BUSY and LCD_PREBUSY signals to the flash memory control module 320 in order to inform the flash memory control module 320 of its operating status. In this embodiment, the IC 300 further comprises a multiplexer 330, which performs a passive pin-sharing management. The multiplexer 330 comprises an output port coupled to the shared pins 331-334 and two input ports coupled to the LCD display control module 310 and the flash memory control module 320. The multiplexer 330 selects one of the signal line 311 of the LCD display control module 310 and the signal line 321 of the flash memory control module 320 to be coupled to the shared pins 311-334 in accordance with an SEL signal (for controlling the selection of the multiplexer 330), wherein the data lines 311, 321 comprise both data and control signal lines. Besides, in another case of the present invention, the flash memory control module 320 and the multiplexer 330 can further be implemented within a single first control module 360 as shown in FIG. 3. Both of these different arrangements about the flash memory control module 320 and the multiplexer 330 (e.g. separated or incorporated) fall within the scope of the present invention.

The signal line 322 is coupled to the flash memory control module 320, and utilized for transmitting data output by the flash memory module 390 into the flash memory control module 320. The flash memory control module 320 further generates an NF_CSJ signal to the flash memory module 390 via a single pin 335 while the LCD display control module 310 further generates an LCD_CSJ signal to the LCD display module 380 via a single pin 336. It should be noted that the flash memory module 390 will accept signals on the shared pins 331-334 only if the NF_CSJ signal is asserted while the LCD display control module 380 will accept signals on the shared pins 331-334 only if the LCD_CSJ signal is asserted.

Figure 4:
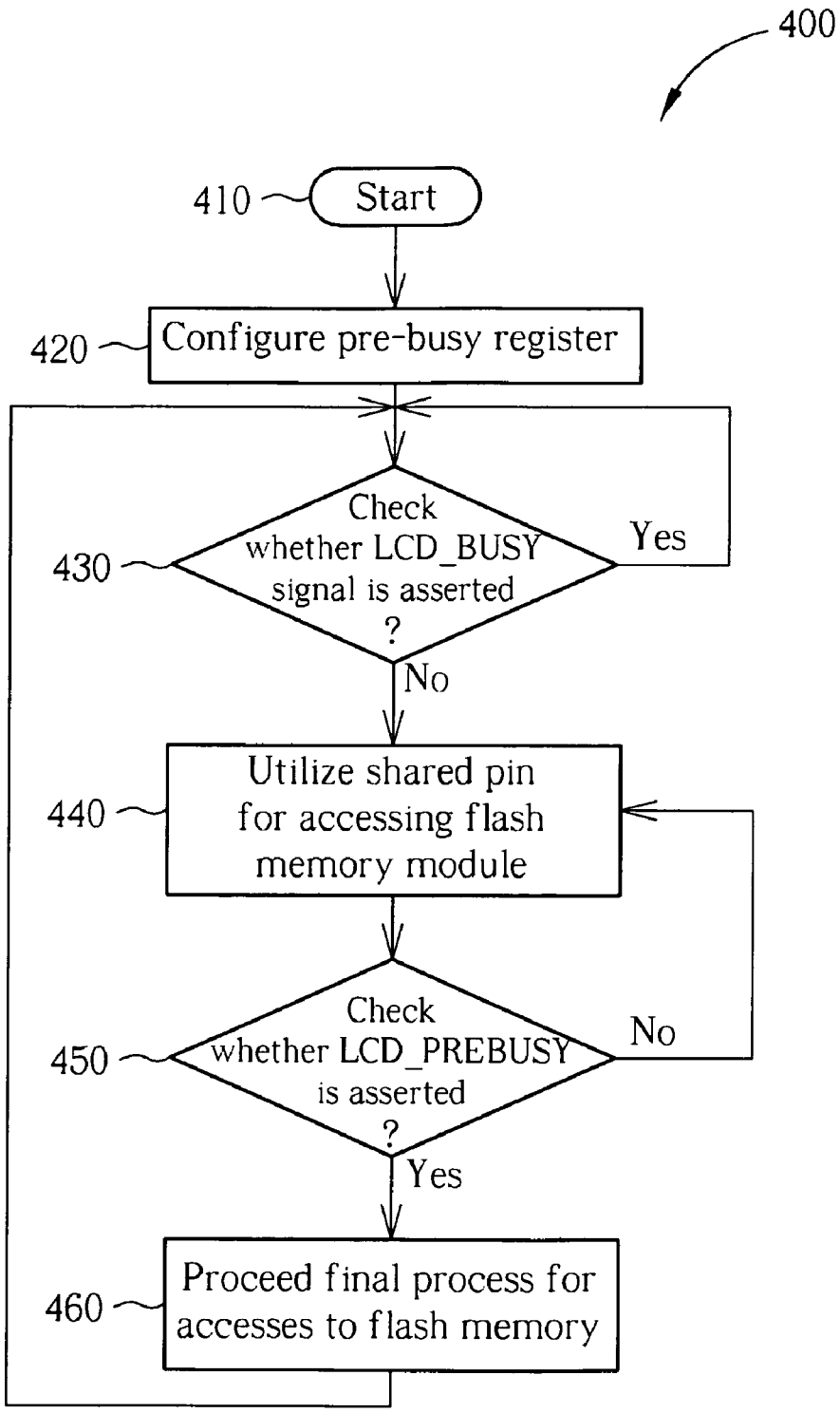
FIG. 4 is a flow chart detailing internal operations of the IC shown in FIG. 3.

Please refer to FIG. 3 and FIG. 4 at the same time. FIG. 4 illustrates a flow chart of the internal operations of the IC 300 shown in FIG. 3. At first, the flash memory module 390 is initialized by its internal controller (not shown). In step 420, a pre-busy register is configured, which corresponds to information about the timing that the LCD display control module 310 refreshes the LCD display module 380 when the LCD_PREBUSY is asserted. Then, the flash memory control module 320 checks if the LCD_BUSY signal is asserted in step 430. If the LCD_BUSY signal is asserted, it stands for the fact that the LCD display control module 310 is accessing the shared pins 331-334 for transmitting data about frame refreshing, and the process stops at step 430 for repeatedly checking if the LCD_BUSY signal is asserted. If the LCD_BUSY signal is not asserted, it stands for the fact that there are no corresponding signals on the shared pins 331-334 that exist for the LCD display control module 310, and the flash memory control module 320 is therefore allowed to access the flash memory module 390 via the shared pins 331-334; the flow then proceeds to step 440. In step 440, the flash memory control module 320 utilizes the shared pins 331-334 for transmitting control signals, memory addresses, and data (or receiving data) with the flash memory module 390.

In step 450, the flash memory control module 320 checks if the LCD_PREBUSY signal is asserted. If the LCD_PREBUSY signal is asserted, it stands for the fact that the LCD display control module 310 will utilize the shared pins 331-334 for transmitting data/control signals about frame refreshing after a certain period; otherwise, the flow returns to step 440, where the flash memory control module 320 continues data access to the flash memory module 390. In step 450, the LCD_PREBUSY signal is repeatedly checked to determine whether it is asserted or not. Finally, in step 460, the flash memory control module 320 proceeds to the final process for advancing to finish the transmission under processing after being informed of handing over the access right of the shared pins 331-334 to the LCD display control module 310.

For instance, if a proceeding data transmission cannot be completed in a certain period, the uncompleted part will be stored into a buffer. When the LCD display control module 310 does not occupy the shared pins 331-334, the data stored in the buffer will be taken out and continue to be processed. After all data transmissions are accomplished, the flow proceeds to step 430.

In accordance with the said LCD_BUSY signal and the control signal of the flash memory control module 320 (e.g. the Write Enable (WE) signal, not shown), a multiplexing control signal, SEL, is generated (which is further employed for indicating the access right of the shared pins) for selecting one of the LCD display control module 310 and the flash memory control module 320 to access signals on the shared pins 331-334.

More precisely, the flash memory control module 320 is allowed to configure the SEL signal as the value that makes the flash memory control module 320 couple to the shared pins 331-334 (e.g. "1") only when the flash memory control module 320 requires access of the flash memory module 390 and the LCD_BUSY is also not asserted. Otherwise, if the SEL signal only depends on the requirement that the flash memory control module 320 accesses the flash memory module 390, errors may occur in data transmission.

In addition, the foregoing enablement signal NF_CSJ is very similar to the chip enable (CE) signal of the flash memory module 390. When the NF_CSJ is asserted, it stands for the fact that the signals existing on the shared pins 331-334 are the signals which the flash memory control module 320 plans to transmit to the flash memory module 390. The flash memory module 390 loads signals on the shared pins 331-334 (which may include: instructions, memory address, or data). Therefore, the NF_CSJ signal is generated on the basis of the LCD_BUSY signal. Similarly, the LCD_CSJ signal has the same meaning, i.e. it is utilized for determining whether the LCD display module 380 should accept signals existing on the shared pins 331-334.

One technical feature of the present invention is the display control module having the higher priority can transmit control signals for the access right of the shared pins according to its requirement. In this embodiment, the display control module is the LCD display control module 310 while the control signals are, respectively, the pre-busy signal, LCD_PREBUSY and the busy signal, LCD_BUSY. As a result, at the specific period before the LCD display control module 310 needs to use the shared pins 311-334, the LCD_PREBUSY signal is generated to the flash memory control module 320 in order to remind the flash memory control module 320 to complete operations currently processing on the shared pin as soon as possible, and then hand over the access right of the shared pins 331-334.

Once the LCD_BUSY signal is asserted, the flash memory control module 320 cannot use the shared pins 331-334 anymore; accordingly, the flash memory control module 320 checks the LCD_BUSY signal prior to proceeding with data access to the flash memory module 390. The flash memory control module 320 is granted to deal with the follow-up data transmissions corresponding to the flash memory module 390 only if the LCD_BUSY is not asserted. In conclusion, there is a specific period between the LCD_PREBUSY signal being asserted and the LCD_BUSY signal being asserted, which is a buffer time for the flash memory control module 320 completing the processing data transmission. The length of the specific period depends on the circuitry characteristics of the flash memory control module 320 and the flash memory module 390, such as gate delay, meta-stability, and write/read pulse width.

Thus, according to the embodiments illustrated in FIG. 3 and FIG. 4, the LCD_PREBUSY signal can substitute for the LCD_BUSY signal generated before the said specific period. There is another embodiment of the present invention where the said LCD display control module 310 only generates the LCD_BUSY signal to the flash memory control module 320. Accordingly, the LCD_CSJ signal can be directly decided by the LCD_BUSY signal.

In the above-mentioned case, the pin-sharing management module is implemented with a multiplexer, and the access right of the shared pins is controlled by the SEL signal passively. However, according to one exemplary embodiment of the present invention, the pin-sharing management module could be incorporated with the first control module. That is to say, in this exemplary embodiment, the first control module is granted to access the shared pin by the determination of the inner pin-sharing management module. In addition, the pin-sharing management module of the present invention can also be implemented in an active manner, which is explained in the following.

Figure 5:
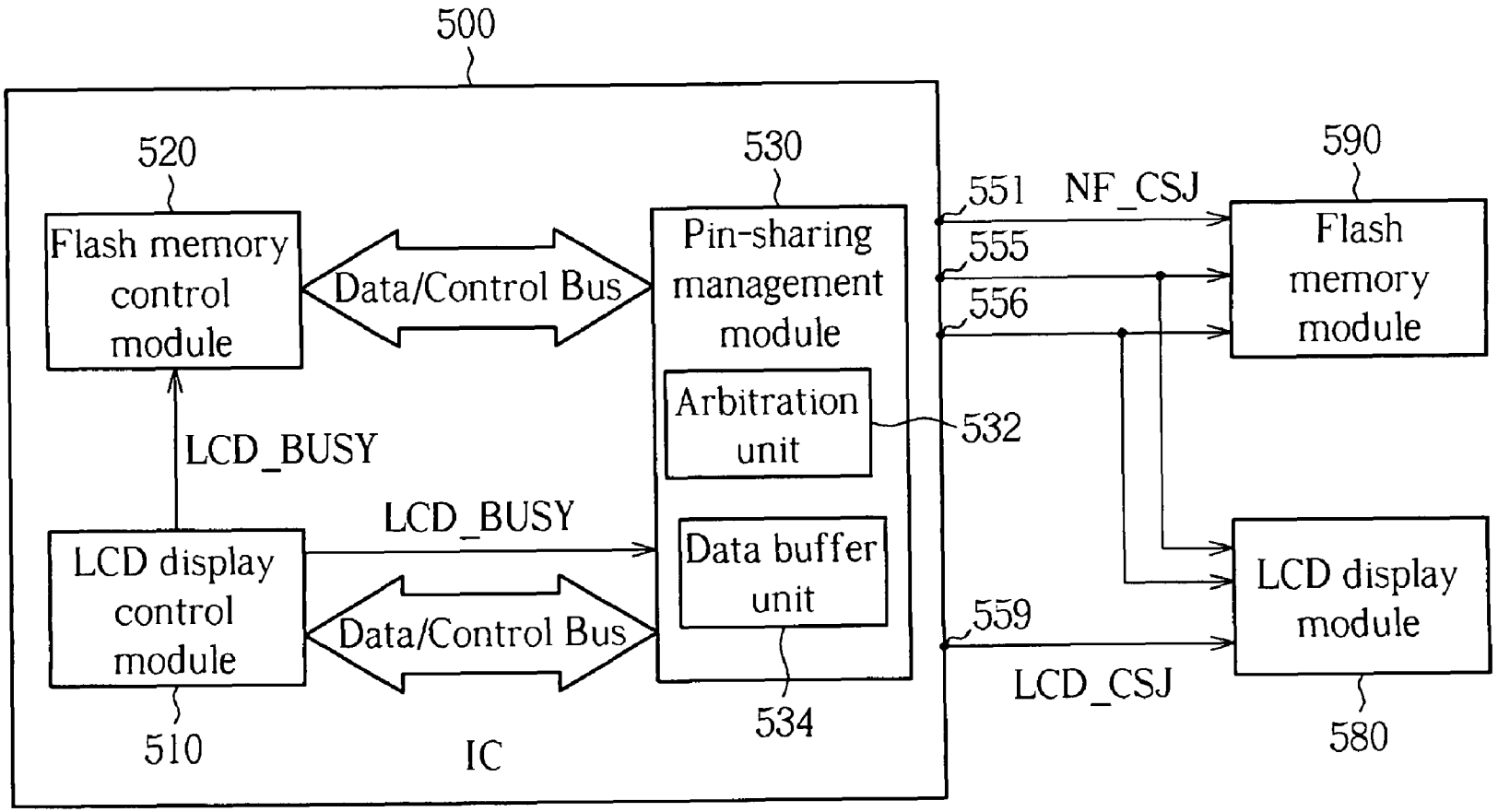
FIG. 5 is a block diagram of an IC with a shared pin according to another exemplary embodiment of the present invention.

Since the shared pin is a concept similar to bus architecture, the pin-sharing management module can be easily implemented with an arbiter. Please refer to FIG. 5, which illustrates a pin-sharing IC of the present invention with an arbitration unit serving as a pin-sharing management module in the IC. As shown FIG. 5, an LCD display module 580 and a flash memory module 590 are externally coupled to the IC 500. The IC 500 comprises an LCD display control module 510, a flash memory control module 520, and a pin-sharing management module 530 coupled to an LCD display module 580 and a flash memory module 590 via two shared pins 555 and 556. The LCD_CSJ and NF_CSJ signals are respectively transmitted via the pin 551 and pin 559. The LCD display control module 510 and the flash memory control module 520 are respectively coupled to the pin-sharing management module 530, and transmit and receive control/data signals between the LCD display module 580 and the flash memory module 590 via specific buses to the pin-sharing management module 530 and then via the shared pins. The LCD display control module 510 generates the LCD_BUSY signal to the pin-sharing management module 530 and the flash memory control module 520 respectively to inform the modules of its operating status.

The pin-sharing management module 530 comprises an arbitration unit 532 and a data buffer unit 534. In this embodiment, the LCD display control module 510 acts in the role of requesting for the shared pin. Before the LCD display control module 510 is about to transmit control and data signals to the LCD display module 580 for refreshing the LCD display module 580, the LCD display control module 510 asserts the LCD_BUSY signal in order to inform the flash memory control module 520 in advance that it will soon occupy the shared pins 555 and 556. The LCD_BUSY signal is also transmitted to the pin-sharing management module 530, wherein the arbitration unit 532 grants the LCD display control module 510 the access right of the shared pin 555 and 556 according to the LCD_BUSY signal.

After a specific period (as mentioned in the case shown in FIG. 3), the arbitration unit 532 will grant the LCD display control module 510 the access right of the shared pins 555 and 556 when receiving the LCD_BUSY signal. In that specific period, the flash memory control module 520 performs the final process for finishing the transmission under process. The final process may comprise two possible situations: 1) the flash memory control module 520 and the flash memory module 590 can complete the processing data transmission within the specific period, and then hand over the access right of shared pins 555 and 556; 2) the flash memory control module 520 and the flash memory module 590 cannot complete the processing data transmission within the specific period, and then incomplete data will be temporarily stored, wherein data that has not been written into the flash memory module 590 in time, or memory addresses corresponding to data that has not been read from the flash memory module 590 in time will be stored into the data buffer unit 534.

When flash memory control module 520 owns the access right of the shared pins 555 and 556 once again, the incomplete data transmission remaining in the data buffer unit 534 continues to be processed. Moreover, as long as the LCD_BUSY signal is received, the flash memory control module 520 starts to perform the final process. Detailed descriptions about the NF_CSJ and LCD_CSJ transmitted via the shared pins 551 and 559 similar to those explained in the foregoing embodiment are omitted here for the sake of brevity.

Figure 6:
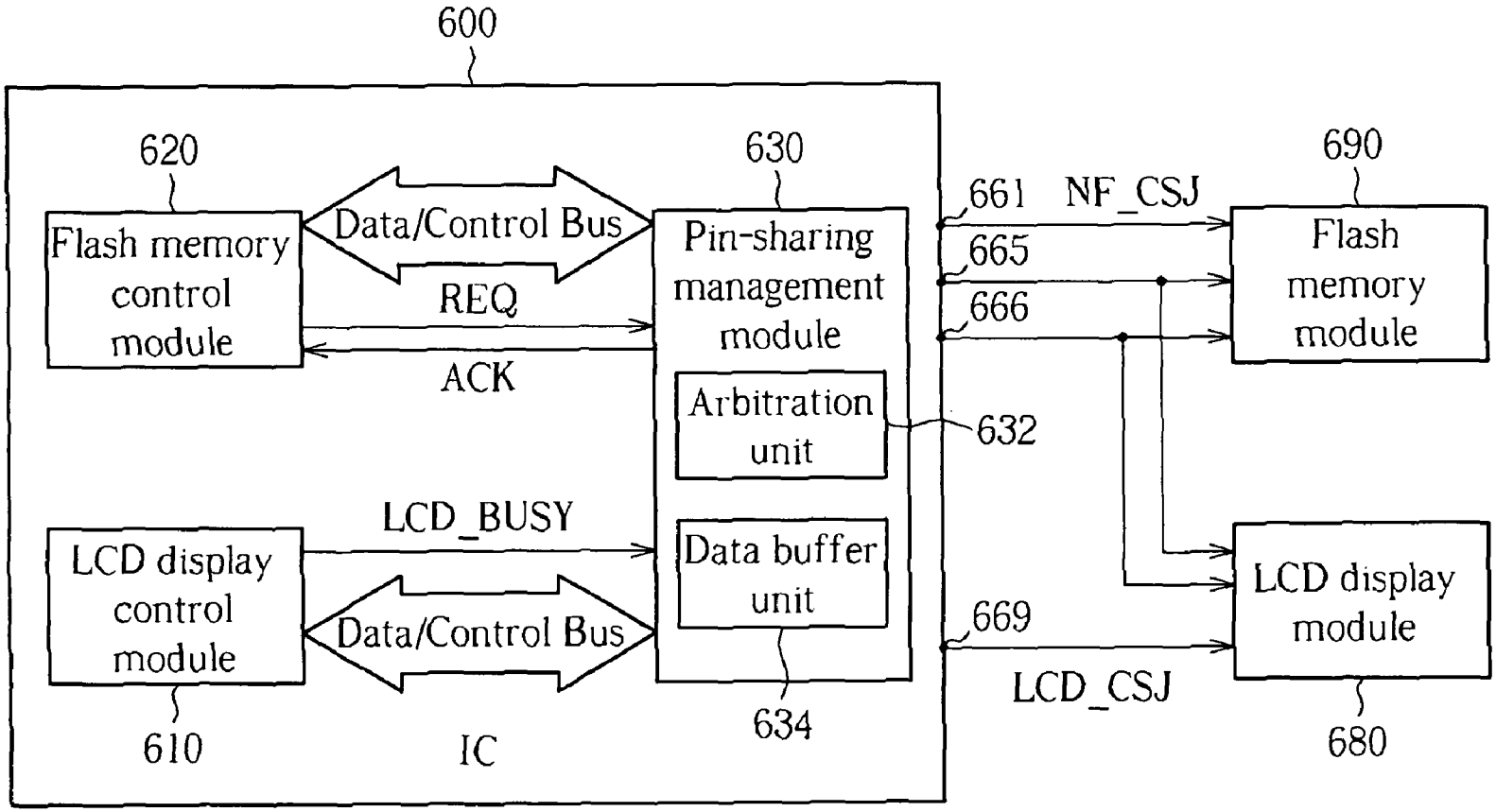
FIG. 6 is a block diagram of an IC with a shared pin according to another exemplary embodiment of the present invention.

In another embodiment of the present invention, however, the request for the access right of the shared pins may be applied by the flash memory control module in the IC having an active pin-sharing management module. Please refer to FIG. 6, which illustrates another possibility regarding which control module requests the access right of the shared pins. On comparing FIG. 6 with FIG. 5, it can be clearly seen that the IC 500 and the IC 600 both have the same architecture, and the access right of the shared pins 555, 556 and the shared pins 665, 666 is determined by means of the pin-sharing management module 530 and 630, respectively. The pin-sharing management module 630 generates the NF_CSJ signal and the LCD_CSJ signal to the LCD display module 680 and the flash memory 690 and the pin-sharing management module 530 generates the NF_CSJ signal and the LCD_CSJ signal to the LCD display module 580 and the flash memory module 590. The flash memory control module 620, however, generates a REQ signal in the embodiment shown in FIG. 6. The pin-sharing management module 630 generates an ACK signal in response to the REQ signal to inform the flash memory control module 620 of whether to be granted access to the shared pins 665 and 666 according to the operating status of the LCD display control module 610.

By means of checking if the LCD_BUSY signal is asserted, an arbitration unit 632 of the pin-sharing management module 630 can know if the LCD display module 680 is performing a frame refresh operation, and can thereby find out whether the shared pins are occupied by the LCD display control module 61 0. If the LCD_BUSY signal is not asserted, the arbitration unit 632 will respond with the ACK signal to the flash memory control module 620. Thus, the flash memory control module 620 is granted to use the shared pins 665 and 666 to access the flash memory module 690, and the NF_CSJ is therefore asserted. However, if the LCD_BUSY signal is asserted, the arbitration unit 632 will check the data storage status of the data buffer unit 634. If there is still available space in the data buffer unit 634, the control/data signals to be transmitted between the flash memory control module 620 and the flash memory module 690 will be temporarily stored into the data buffer unit 634. Accordingly, the arbitration unit 632 also generates an ACK signal to inform the flash memory control module 620 of outputting data, and data will then be stored into the data buffer unit 634 of the pin-sharing management module 630.

In terms of the above-mentioned embodiment, despite the LCD display control module 610 has the higher priority for the shared pins 665 and 666, it is possible that the flash memory control module 620 having the lower priority for the shared pins 665 and 666 requests for the access right of the shared pins 665 and 666. Data that has not been processed by the flash memory control module 620 within the period between two frame refresh timings will be stored into the data buffer unit 634. After the access right of the shared pins 665 and 666 are released, the flash memory control module 620 utilizes the shared pins 665 and 666 and data temporarily stored in the data buffer unit 634 to perform the previously unfinished data transmission. Presuming that the LCD display module 680 maintains normal operation, data access to the flash memory module 690 can still maintain certain efficiency.

In addition to the foregoing embodiments, there are still alternative embodiments that fall within the scope of the present invention, which are illustrated as follows.

Figure 7:
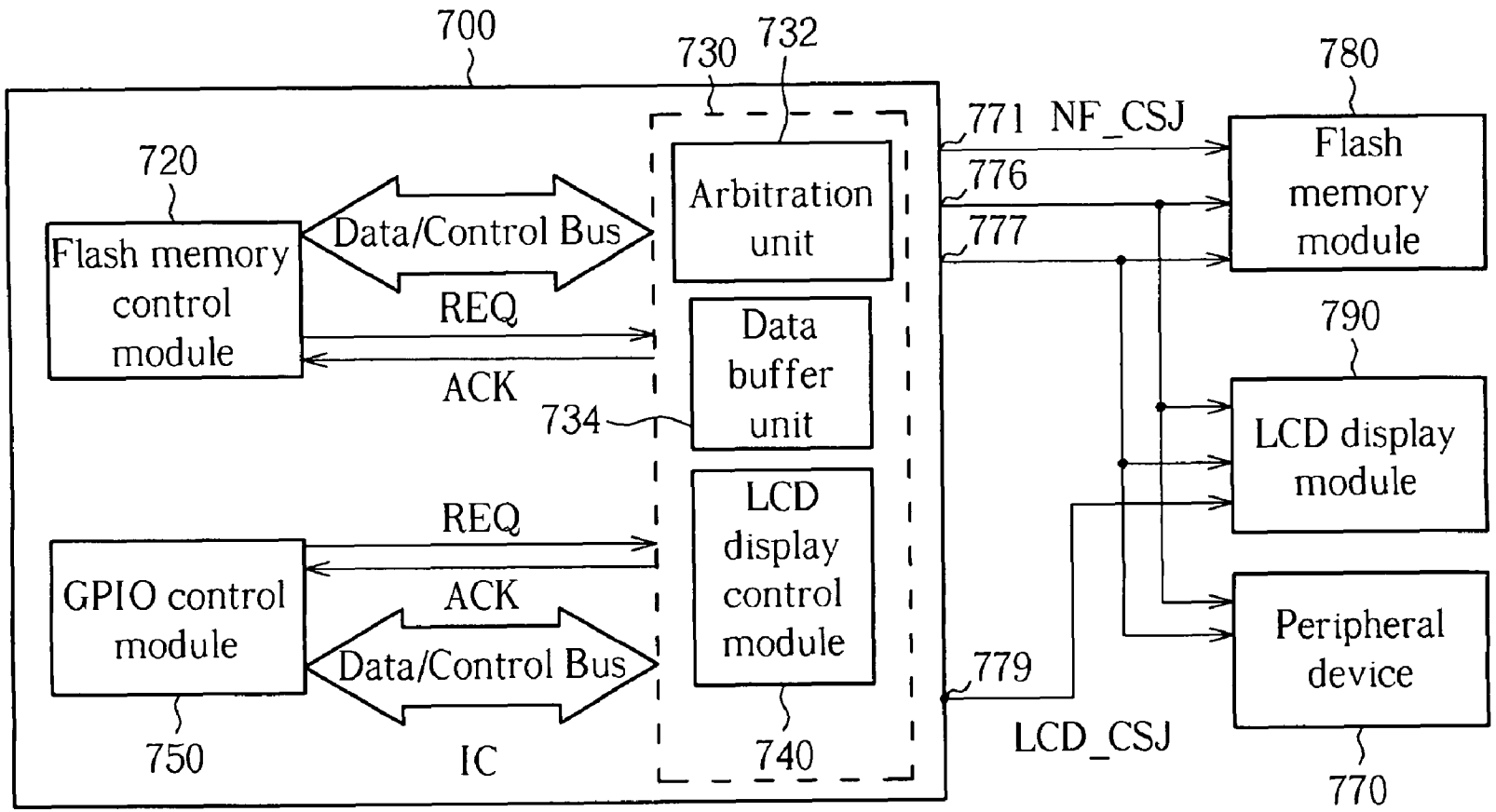
FIG. 7 is a block diagram of an IC with a shared pin according to another exemplary embodiment of the present invention.

Please refer to FIG. 7. An IC 700 comprises a flash memory control module 720, a General purpose Input/Output (GPIO) control module 750, and an LCD display control module 740, wherein the GPIO control module 750 is utilized for controlling a peripheral apparatus 770. Under the assumption that the LCD display module 790 operates without any faults, the IC 700 of the present invention can only utilize shared pins 776 and 777 for transmitting signals, thereby controlling three different control modules. Another feature of this embodiment is that the LCD display control module 740, the data buffer unit 734, and the arbitration unit 732 are integrated on a single circuit block 730, resulting in less circuitry latency when the arbitration unit 732 checks the operating status of the LCD display module 790. In this way, the break between two frame refresh timings of the LCD display module 790 can be utilized more effectively. The IC 700 of the present invention is therefore able to control the display module and more than one additional circuit module via shared pins.

In more detail, the flash memory control module 720 and the GPIO control module 750 both send a REQ signal to the arbitration unit 732 in order to request for access right of the shared pins 776 and 777. The arbitration unit 732 in the circuit block 730 rapidly checks the operating status of the LCD display control module 740 to determine the priority regarding the two REQ signals so as to generate the corresponding ACK signal.

If it is known that the LCD display control module 740 is only using the shared pins 776 and 777 for refreshing the LCD display module 790 after checking, the data storage status of the data buffer unit 734 will then be checked. If there is still available space, the ACK signal is also sent in response to the control module that generates the REQ signal, for temporarily storing data in the data buffer unit 734.

Finally, if the data storage status of the data buffer unit 734 cannot allow more data to be stored into the data buffer unit 734, the arbitration unit 732 will not send any ACK signal to the control modules. It should be noted that, despite the foregoing embodiments using the LCD display module and the flash memory module as examples, those skilled in the art can easily apply teachings of the present invention to any flash memory-based storage apparatus like SD cards or MMCs. In this way, the SD_CLK signal of the SD card and the MMC_CLK signal of the MMC card can serve as the enablement signal, and the LCD display module can also be substituted for other display apparatus.

Those skilled in the art will readily observe that numerous modifications and alterations of the device and method may be made while retaining the teachings of the invention.

What is claimed is:

1. An integrated circuit for controlling operations of a display module and a first circuit module, comprising:

a shared pin;

a display control module, for controlling operations of the display module externally coupled to the integrated circuit via the shared pin, wherein the display control module further generates a pin-sharing control signal according to an operation status of the display control module;

a first control module, for controlling operations of the first circuit module externally coupled to the integrated circuit via the shared pin; and a pin-sharing management module, coupled to the display control module, the first control module and the shared pin, for granting one of the display control module and the first control module access to the shared pin according to the pin-sharing control signal, wherein the pin-sharing management module comprises:

a data buffer unit; and an arbitration unit, for temporarily storing data which has not been transmitted completely between the first control module and the first circuit module into the data buffer unit, and granting the display control module the access right of the shared pin when receiving the pin-sharing control signal from the display control module.

2. The integrated circuit of claim 1, wherein the first control module further generates a request signal to the arbitration unit, and the arbitration unit determines whether to generate an acknowledge signal to grant the first control module access to the shared pin according to at least the operating status of the display control module after receiving the request signal.

3. The integrated circuit of claim 2, wherein the arbitration unit determines whether to generate the acknowledge signal according to the operating status of the display control module and the data buffering status of the data buffer unit after receiving the request signal.

4. The integrated circuit of claim 1, wherein the first control module further generates a request signal to the arbitration unit, and the arbitration unit determines whether to generate an acknowledge signal to grant the first control module access to the shared pin according to the data buffering status of the data buffer unit after receiving the request signal.

5. The integrated circuit of claim 1, further comprising:

a second control module, for controlling operations of a second circuit module externally coupled to the integrated circuit, wherein the pin-sharing management module and the display control module are integrated with a same circuit, and the pin-sharing management module coupled to the second control module is utilized for granting one of the display control module, the first control module and the second control module access to the shared pin according to the pin-sharing control signal.

6. The integrated circuit of claim 5, wherein the arbitration temporarily stores data which has not been transmitted completely between the first control module and the first circuit module, or between the second control module and the second circuit module into the data buffer unit, and granting the display control module the access right of the shared pin when receiving the pin-sharing control signal from the display control module.

7. The integrated circuit of claim 6, wherein at least one of the first and the second control modules generates a request signal to the arbitration unit, and the arbitration unit determines whether to generate an acknowledge signal to the control module which generates the request signal in order to grant the control module access to the shared pin according to at least the operating status of the display control module and/or the data buffering status of the data buffer unit after receiving the request signal.

8. The integrated circuit of claim 7, wherein the arbitration unit determines whether to generate an acknowledge signal to the control module which generates the request signal in order to grant the control module access to the shared pin according to the operating status of the display control module and the data buffering status of the data buffer unit after receiving the request signal.

9. The integrated circuit of claim 1, wherein the first control module further generates a control signal to the first circuit module for controlling the enablement state of the first circuit module according to the pin-sharing control signal.

10. The integrated circuit of claim 1, wherein the display control module further generates a control signal to the display module for controlling the enablement state of the display module.

11. The integrated circuit of claim 1, wherein the display module is not provided with a frame buffer.

12. A method for controlling a display module and a first circuit module by utilizing a display control module and a first control module in an integrated circuit, comprising:

coupling the display module, the first circuit module, the display control module, and the first control module to a shared pin of the integrated circuit;

generating a pin-sharing control signal according to the operating status of the display control module;

checking whether the pin-sharing control signal is asserted;

granting the display control module access to the display module via the shared pin if the pin-sharing control signal is asserted; and granting the first control module access to the first circuit module via the shared pin if the pin-sharing control signal is not asserted, comprising:

temporarily storing data which has not been transmitted completely from the first circuit module into a data buffer unit if the pin sharing control signal is asserted.

13. The method of claim 12, further comprising:

generating a request signal before the first control module controls the first circuit module via the shared pin, and determining whether to generate an acknowledge signal in response to the request signal in order to grant the first control module access to the shared pin for controlling the first circuit module according to at least the operating status of the display control module and/or the data buffering status of the data buffer unit.

14. The method of claim 12, further comprising:

a second control module in the integrated circuit controlling operations of a second circuit module externally coupled to the integrated circuit via the shared pin.

15. The method of claim 14, further comprising:

temporarily storing data which has not been transmitted completely from the first circuit module into a data buffer unit if the pin-sharing control signal is asserted.

16. The method of claim 15, further comprising:

generating a request signal before the first and the second control modules control one of the first and the second circuit modules via the shared pin, and determining whether to generate an acknowledge signal in response to the request signal in order to grant the first and the second control modules access to the shared pin for controlling the circuit module according to at least one of the operating status of the display control module and/or the data buffering status of the data buffer unit.

17. The method of claim 14, further comprising:

the second control module generating a control signal to the second circuit module for controlling the enablement state of the second circuit module according to the pin-sharing control signal.

18. The method of claim 12, further comprising:

the first control module generating a control signal to the first circuit module for controlling the enablement state of the first circuit module according to the pin-sharing control signal.

19. The method of claim 12, further comprising:

the display control module generating a control signal to the display module for controlling the enablement state of the display module.

20. An integrated circuit for controlling operations of a display module and a first circuit module, comprising:

a shared pin;

a display control module, for controlling operations of the display module externally coupled to the integrated circuit via the shared pin, wherein the display control module further generates a pin-sharing control signal according to an operation status of the display control module;

a first control module, for controlling operations of the first circuit module externally coupled to the integrated circuit via the shared pin; and a pin-sharing management module, coupled to the display control module, the first control module and the shared pin, for granting one of the display control module and the first control module access to the shared pin according to the pin-sharing control signal, comprising:

a multiplexer having a first input port coupled to the display control module, a second input port coupled to the first control module and an output port coupled to the shared pin, the multiplexer selecting one of the first and second input ports to be coupled to the output port in accordance with a multiplexing control signal, wherein the first control module is further coupled to the display control module, and generates the multiplexing control signal to the multiplexer according to the pin-sharing control signal generated by the display control module.

* * * * *